US011064845B2

(12) United States Patent
Lee et al.

(10) Patent No.: US 11,064,845 B2
(45) Date of Patent: Jul. 20, 2021

(54) SEMI-OPEN SHOWERING DEVICE

(71) Applicants: Ka Shek Neville Lee, Honk Kong (HK); Sing-kwong Samuel Hui, Hong Kong (HK)

(72) Inventors: Ka Shek Neville Lee, Honk Kong (HK); Sing-kwong Samuel Hui, Hong Kong (HK)

( * ) Notice: Subject to any disclaimer, the term of this patent is extended or adjusted under 35 U.S.C. 154(b) by 70 days.

(21) Appl. No.: 16/313,124

(22) PCT Filed: Jul. 19, 2017

(86) PCT No.: PCT/CN2017/093511
§ 371 (c)(1),
(2) Date: Dec. 24, 2018

(87) PCT Pub. No.: WO2018/014844
PCT Pub. Date: Jan. 25, 2018

(65) Prior Publication Data

US 2019/0159633 A1 May 30, 2019

Related U.S. Application Data

(60) Provisional application No. 62/363,920, filed on Jul. 19, 2016, provisional application No. 62/407,547, filed on Oct. 13, 2016.

(51) Int. Cl.
*A47K 3/022* (2006.01)
*A47K 3/00* (2006.01)
(Continued)

(52) U.S. Cl.
CPC ..... *A47K 3/022* (2013.01); *A47K 3/001* (2013.01); *A47K 3/006* (2013.01); *A47K 3/122* (2013.01); *A61H 2035/004* (2013.01)

(58) Field of Classification Search
CPC ..... A47K 3/001; A47K 3/006; A47K 3/022; A47K 3/122; A61H 2035/004
(Continued)

(56) References Cited

U.S. PATENT DOCUMENTS 3,562,821 A * 2/1971 Queen ..... A47K 3/006 4/604
4,112,524 A 9/1978 Johansson
(Continued)

FOREIGN PATENT DOCUMENTS

CN 104287505 1/2015
CN 204636190 9/2015

OTHER PUBLICATIONS

ISR for PCT/CN2017/093511 completed Sep. 25, 2017.

*Primary Examiner* — Tuan N Nguyen

(57) ABSTRACT

A semi-open bathing device (200) is provided, one aspect of which relates to multi-function showering device, comprising a chair assembly, a plurality of first dispensers (220/222), a supply assembly, a temperature regulator, and a waste water management assembly. In the semi-open bathing device (200), the chair assembly comprises a seat (202) with a hole (204) disposed in the center of the seat (202). A backrest (206) and two sidewalls (214) are coupled to the seat (202) respectively thereby forming a front opening for the chair assembly. The backrest (206) provides a support for the bather and the two sidewalls (214) are configured to contain the spillage of water. The plurality of first dispensers (220/222) is positioned onto the sidewalls (214) and/or the backrest (206) for dispensing water and/or air towards the bather. The supply assembly is located at backside of the backrest (206) for connecting to a water supply and an electricity supply.

20 Claims, 22 Drawing Sheets

(51) Int. Cl.
*A47K 3/12* (2006.01)
*A61H 35/00* (2006.01)

(58) Field of Classification Search
USPC ..... 4/590, 604, 663, 667
See application file for complete search history.

(56) References Cited

U.S. PATENT DOCUMENTS

| | | | | |
|---|---|---|---|---|
| 4,817,219 | A * | 4/1989 | Schenstrom | A47K 3/006 4/590 |
| 5,978,983 | A | 11/1999 | Queen et al. | |
| 6,516,477 | B1 * | 2/2003 | Storm | A47K 3/006 4/604 |
| 2001/0041852 | A1 | 11/2001 | Park | |
| 2010/0101015 | A1 | 4/2010 | Mondrush | |
| 2014/0131459 | A1 * | 5/2014 | Dorendorf | E03D 9/04 236/49.3 |
| 2018/0014697 | A1 * | 1/2018 | Hong Meng | A47K 3/006 |

* cited by examiner

SEMI-OPEN SHOWERING DEVICE

CROSS-REFERENCE TO RELATED APPLICATIONS

This application claims the benefit of U.S. provisional application No. 62/363,920 filed Jul. 19, 2016, titled "Multi-purpose Bathing Device", and U.S. provisional application No. 62/407,547 filed Oct. 13, 2016, titled "Multi-purpose Bathing System". The entire disclosures of the above-referenced applications are incorporated herein by reference in entirety for all purpose.

TECHNICAL FIELD

The present disclosure relates to an showering device, especially to a multi-function showering device with a seat, faucets for cleaning specific zones, electronic water or air temperature control, and water barrier side walls for containing the spillage of water. Special water dispensers are designed to contain water within the device so that bathing mess is minimized or largely avoided. The showering device can automatically help to clean the bather.

Preferably the present disclosure also allows for simultaneous toilet use to accommodate those with bowel control problems.

BACKGROUND OF THE INVENTION

The prior art contains many examples of bathing aids, and means for bathing or showering the elderly or the mobility impaired. These bathing aids are generally used to make bathing safer. However, a commonly cited criticism of these products (or inventions) is their messiness and lack of practicality 13 in particular: the difficulty to get in and out, difficulty for monitoring, difficulty for caretakers to assist with the cleaning process, difficult to clean, etc.

The most commonly used devices are walk-in tubs and shower chairs. Walk-in tubs have high side walls making it difficult for the caretaker to lean in and assist with cleaning. Additionally, a closed system such as a bathtub often leaves senior feeling trapped, claustrophobic, and are difficult to use independently (due to difficulty getting in and out). There is an additional problem where many seniors suffer from poor bowel control and these closed devices are often more difficult to clean (due to how cramped they are).

Using an open system like shower chairs, on the hand, is a very messy process, especially if placed on top of a toilet for those with bowel control issues. Water and soap spills everywhere with the caretaker and floor often getting wet and creating a slip hazard.

SUMMARY OF THE INVENTION

Thus, an object of the present disclosure is to develop a bathing device that is easily accessible for both an elderly user and caretaker, helps to contain shower water to minimize mess and allows for simultaneous use of the toilet while bathing.

In order to achieve the above mentioned object, a semi-open bathing device is proposed. One aspect of the present disclosure provides a semi-open bathing device, which comprises a chair assembly, a plurality of first dispensers, a supply assembly, a temperature regulator, and a waste water management assembly. In said semi-open bathing device, the chair assembly comprises a seat with a hole disposed in the center of the seat. A backrest and two sidewalls are coupled to the seat respectively thereby forming a front opening for the chair assembly. The backrest provides a support for the bather and the two sidewalls are configured to contain the spillage of water. The plurality of first dispensers is positioned onto the sidewalls and/or the backrest for dispensing water and/or air towards the bather. The supply assembly is located at backside of the backrest for connecting to a water supply and an electricity supply. The electronic devices of the bathing device are powered by said electricity supply. The plurality of first dispensers is connected to the supply assembly such that the first dispensers may dispense water from the water supply. The temperature regulator is coupled to the chair assembly for regulating the temperature of the dispensed water and/or air. The waste water management assembly comprises a water collector being coupled to the central hole of the seat for collecting the waste water. In this embodiment, the seat, the sidewalls, and the backrest are coupled in such a manner to contain and guide the waste water to the central hole and then the waste water management assembly.

In one embodiment, the chair assembly may further comprise a foot tray positioned in front of the seat, such that the bathing water that flows to the feet may be contained. In this manner, the foot tray may be configured to be a part of the waste water management assembly, wherein the water contained in the foot tray may be pumped back or siphoned into a toilet, drain or waste receptacle for disposal. This helps to reduce any mess on the ground and also makes it safer for when the bather stands up to exit the device.

In one embodiment, the chair assembly may have a space formed beneath the seat and an opening at the rear of the chair assembly. With this design, the chair assembly may be space-saving as it is capable of fitting over a toilet or the like. Therefore, the bathing device may be installed in a washroom or somewhere without occupying much room.

In one embodiment, the seat, the sidewalls, and the backrest are coupled together in a substantially water tight manner. In this case, the seat, the sidewalls and the backrest are formed together to be a semi-open space. The backrest and the sidewalls may be functioned as a barrier to block the showering water from splashing outside, and the seat with the backrest and the sidewalls will guide the waste water to the central hole therein and then the water collector of the waste water management assembly. In this manner, the seat may have an inwardly sag towards the hole so that the waste water may flow into the hole rather than remaining on the seat. Since a front opening for the chair assembly is formed thereby, the semi-open space does not obstruct the entry or exit of a bather and helps to contain shower water in order to minimize mess. In a further embodiment, a door or a curtain may be arranged to the front opening so as to further block the showering water from splashing outside. In a further embodiment, the sidewalls may be transparent or translucent.

The plurality of first dispensers are disposed inside the semi-open space, especially onto the backrest and the sidewalls. Preferably, the plurality of first dispensers are arranged at an angle, so that the dispensers may spray the water and/or air at an angle "shearing" or crisscross motion across the back of the bather rather than perpendicular to it. The "shearing" spray of the first dispensers allows the water to stay within a small bathing area even when the bather steps out of the device. In another embodiment, the plurality of first dispensers may each further comprises a nozzle which is rotatable at angles. In this manner, the plurality of dispensers may not be arranged at special angles as the nozzles may be adjusted at angles to the spray the water. In a further embodiment, the nozzles of the first dispensers may be controlled by a control unit, such that the users may change or custom the spray angles and period as desired. As a result, the sprayed water may be kept within the device rather than dispensing outside. Furthermore, the various-angle spray of the water may also wash and clean the bather from all sorts of angles.

In a furthermore embodiment, the first dispensers may divided into separately controllable zones or regions, such that some of the first dispensers may be angled to spray into the formed space from the side or front and downwards towards the foot tray to clean the feet, and other first dispensers may even be configured to sprays upwards towards the armpits of the bather. In this manner, the bathing device may alternate between cleaning different areas of the body of the bather at different periods.

In one embodiment, the bathing device may further comprise a plurality of second dispensers for spraying, dispensing or applying a fluid or liquid to the user or device such as soap, oil, perfume or disinfectant. Optionally, the second dispensers may be arranged onto the sidewall and the backrest just like the plurality of first dispensers. Consequently, the second dispensers may spray the soap, oil, perfume or disinfectant towards to the bather or the device directly. Similar to the first dispensers, the second dispensers may also be controlled by the control unit.

The supply assembly is located at backside of the backrest for connecting to a water supply and an electricity supply. The water supply may be connected to the plurality of first dispensers with piping or conduits. In this embodiment, the second dispensers may be connected to the piping or conduits between the water supply and the first dispensers so that the second dispensers may mix the fluid or liquid with water from the water supply in the piping or conduit.

The electronic devices of the bathing device are connected to the electricity supply, such that they can obtain electricity power from the electricity supply.

In one embodiment, the temperature regulator may comprise a switch for the user to manually adjust the bathing temperature. In another embodiment, the temperature regulator may comprise a temperature sensor, with which the temperature regulator may automatically adjust the temperature of the dispensed water and/or air by analyzing the feedback from the temperature sensor. In these embodiments, the temperature regulator may comprise a water mixer, water heater or water buffer for mixing/heating/buffering the water to be dispensed thereby regulating the temperature of the dispensed water. In a further embodiment, the temperature sensor is connected to the control unit so that the control unit may analyze the feedback from the temperature sensor and command the water mixer, water heater or water buffer to regulate the temperature of the dispensed water.

In one embodiment, a detecting sensor is further provided to the bathing device. The detecting sensor may be triggered when the bather leaves the seat. In this manner, said plurality of first dispensers may be turn off or adjusted in response to the bather's move. In a further embodiment, the detecting sensor is connected to the control unit so as to transmit sensed signal to the control unit, and the control unit commands to turn off or adjust the first dispensers.

In one embodiment, the waste water management assembly may further comprises a pump configured to pump or siphon the waste water from the foot tray or the water collector into a toilet or the like.

In one embodiment, a warmer is provided to the bathing device and connected to the control unit. The control unit is configured for controlling or operating the warmer.

In one embodiment, a bidet is positioned on the seat for cleaning the buttocks or genital areas of the bather.

In one embodiment, the bathing device may further comprise an input means connected to the control unit, allowing the bathing device to clean the various areas of the body of the bather in a sequence automatically or digitally controlled through a program or by a user input. Preferably, the users may use the input means to input the command which is then transmitted to the control unit, and the control unit may perform corresponding functions as the user's input. In a preferred embodiment, the input means is selected from the group consisting of keyboard, remote, external device, facial recognition, scanning, barcode, sensor, voice recognition, or combination thereof.

In one embodiment, the bathing device may further comprise a user feedback system such that the bather is capable of interacting with the bathing device and commanding the bathing device.

In one embodiment, the bathing device may further comprise an odour management assembly. The odour management assembly may comprise an exhaust fan, an air filter or a perfume dispenser.

In one embodiment, the bathing device may further comprise a scrubbing assembly positioned on the backrest behind the user's back like a back support for scrubbing the back or buttocks. In a further embodiment, the scrubbing assembly may comprise a mesh screen or movable brush.

In a second aspect of the present disclosure, many aspects of the bathing system can be automated to allow seniors to bathe independently, or at least significantly reduce the amount of caretaker assistance needed. Across much of the world, caretakers are in short supply and bathing generally requires a lot of caretaker assistance. For seniors, there is a loss of privacy and dignity associated with needing someone to bathe them while caretakers find this task unpleasant.

Thus, it is the intention of this disclosure to address this issue, by offering some automation to the bathing process and decreasing the need for caretaker involvement.

The novel features which are considered as characteristic of the disclosure are set forth in particular in the appended claims. The present disclosure, itself, however, both as to its design, construction and use, together with additional features and advantages thereof, are best understood upon review of the following detailed description with reference to the accompanying drawings.

BRIEF DESCRIPTION OF THE DRAWINGS

Illustrative embodiments of the present disclosure will now be described, by way of example, with reference to the accompanying drawings, in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration.". Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
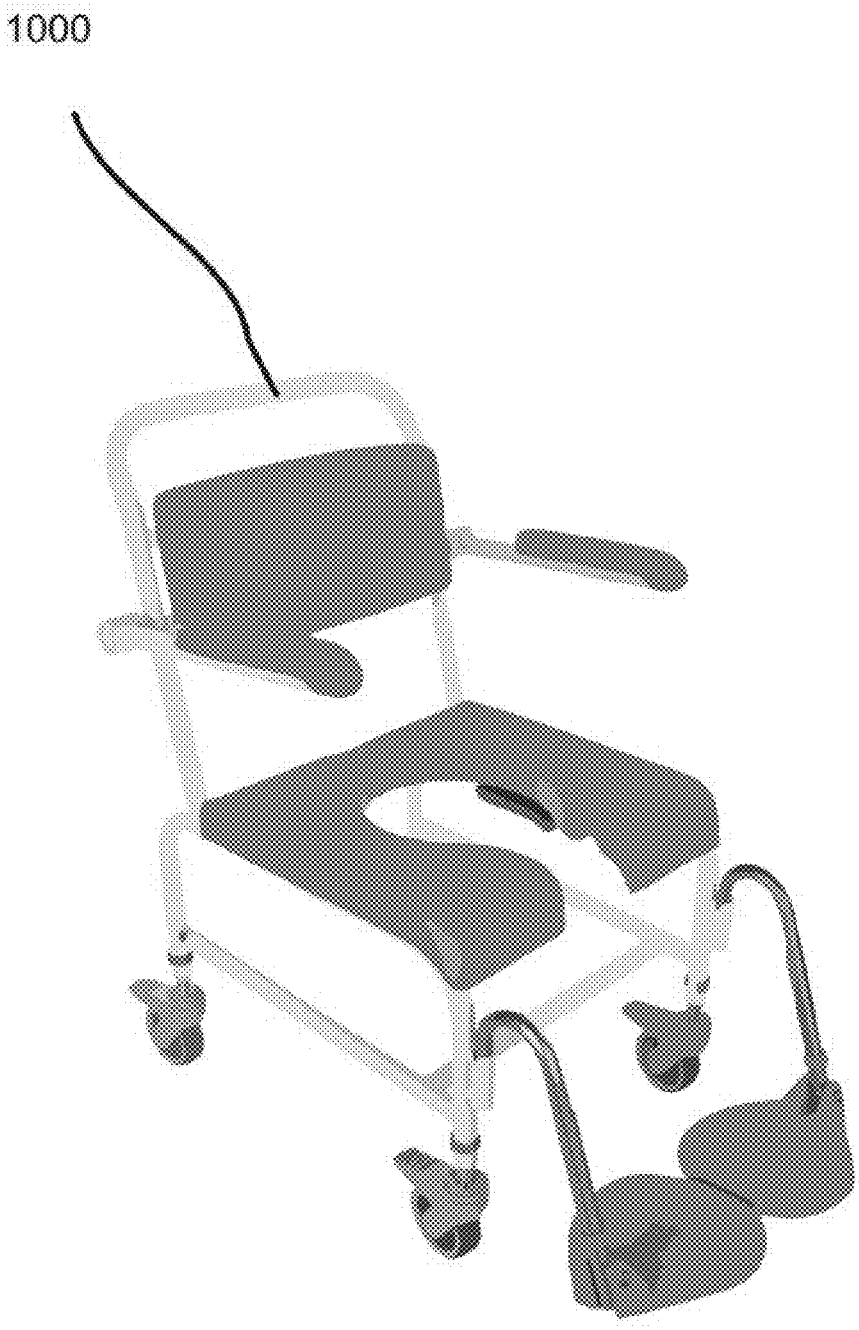
Fig. 1 (Prior Art)
FIG. 1 is a view of a shower chair.

Referring to FIG. 1 which depicts a typical shower chair 1000 with a seat and open, front, back and sides. It is to be noted that an "open" system is one that does not obstruct the entry and exit of bathers, but which similarly does not block water from splashing out and creating a mess or slip hazard. The depicted open system also does not have any features to help seniors bathe on their own. The shower chair 1000 is mounted on wheels. For additional safety, an optional safe belt may be included to ensure the bather does not fall during usage.

Figure 2:
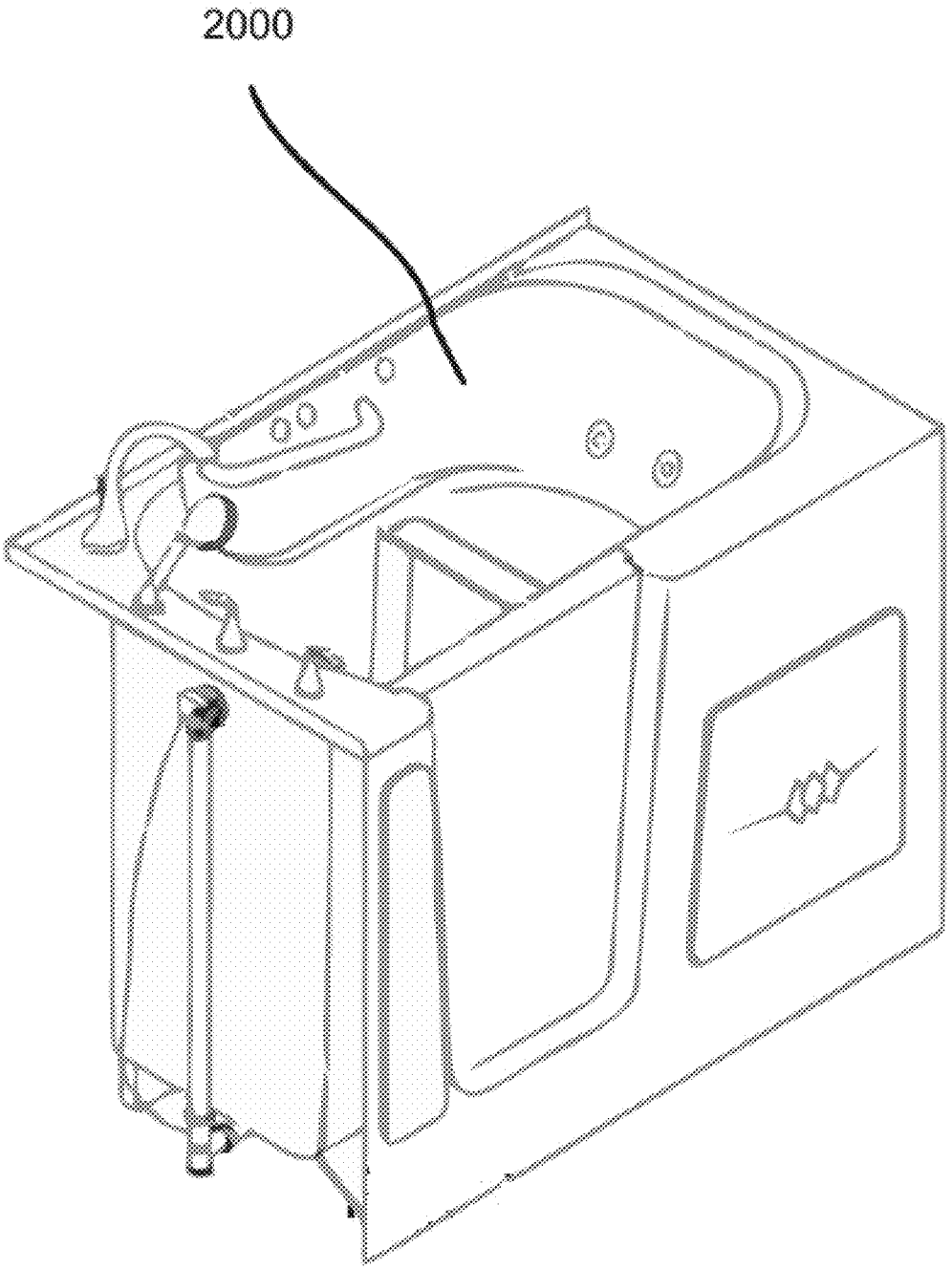
Fig. 2 (Prior Art)
FIG. 2 is a view of a walk-in tub.

Referring to FIG. 2, a typical walk-in tub 2000 is shown. The walk-in tub 2000 has high side walls which traps a bather inside. It can be considered a "closed" system because the device obstructs the entry and exit making it very difficult for the user to get in and out of (without caretaker assistance). The walk-in tub 2000 is also inconvenient to clean but the mess is contained.

The present disclosure intends to get the best of both worlds by introducing a "semi-open" showering device. This is a device that does not obstruct the entry or exit of a bather and helps to contain shower water in order to minimize mess. The semi-open system may also allow for simultaneous toilet and shower use. A semi-open system can optionally do without a door or curtain to block the entry or exit of the device.

Figure 3A:
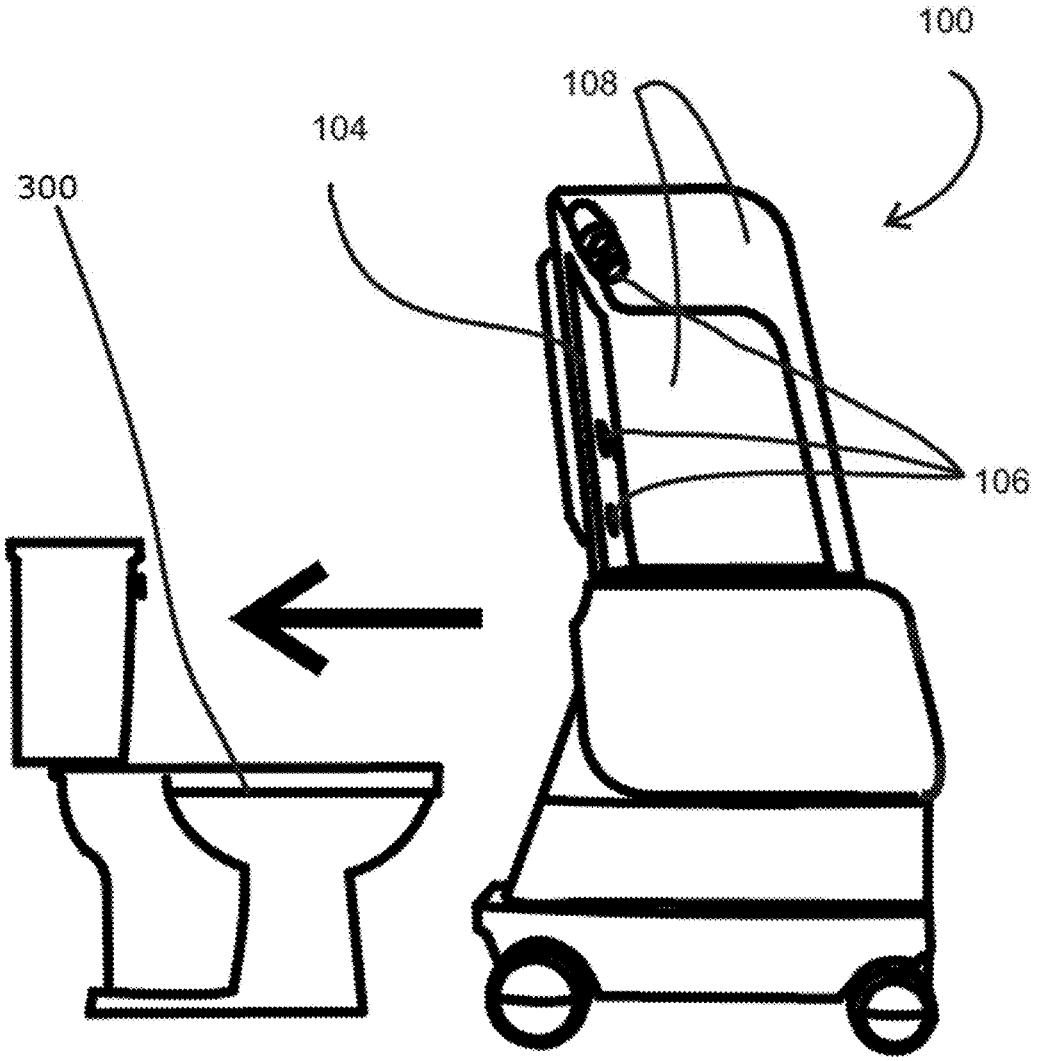
FIG. 3*a* is a side view of a semi-open bathing device according to one embodiment of the present disclosure.
Figure 3B:
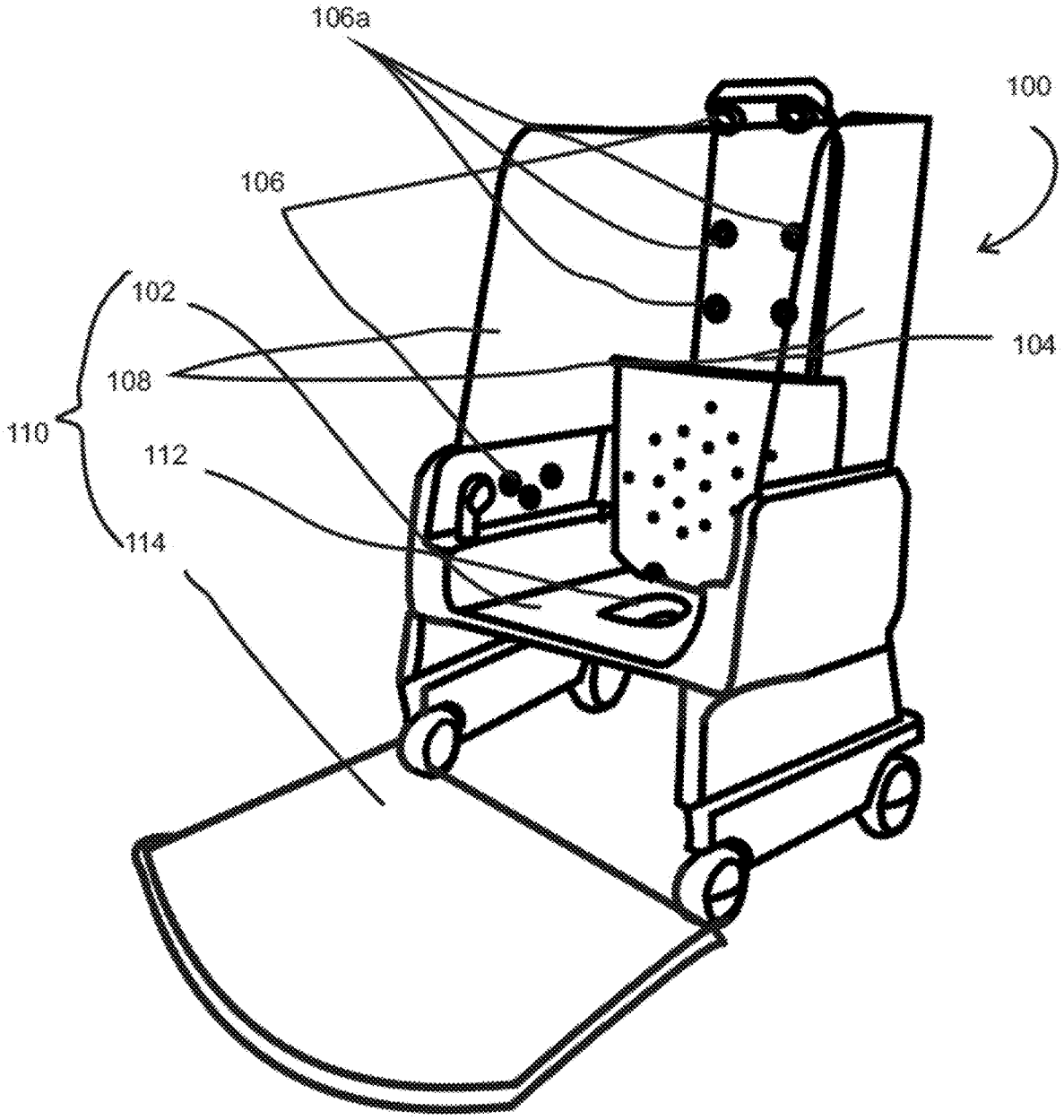
FIG. 3*b* is a front view of the semi-open bathing device of FIG. 3*a;*
Figure 3C:
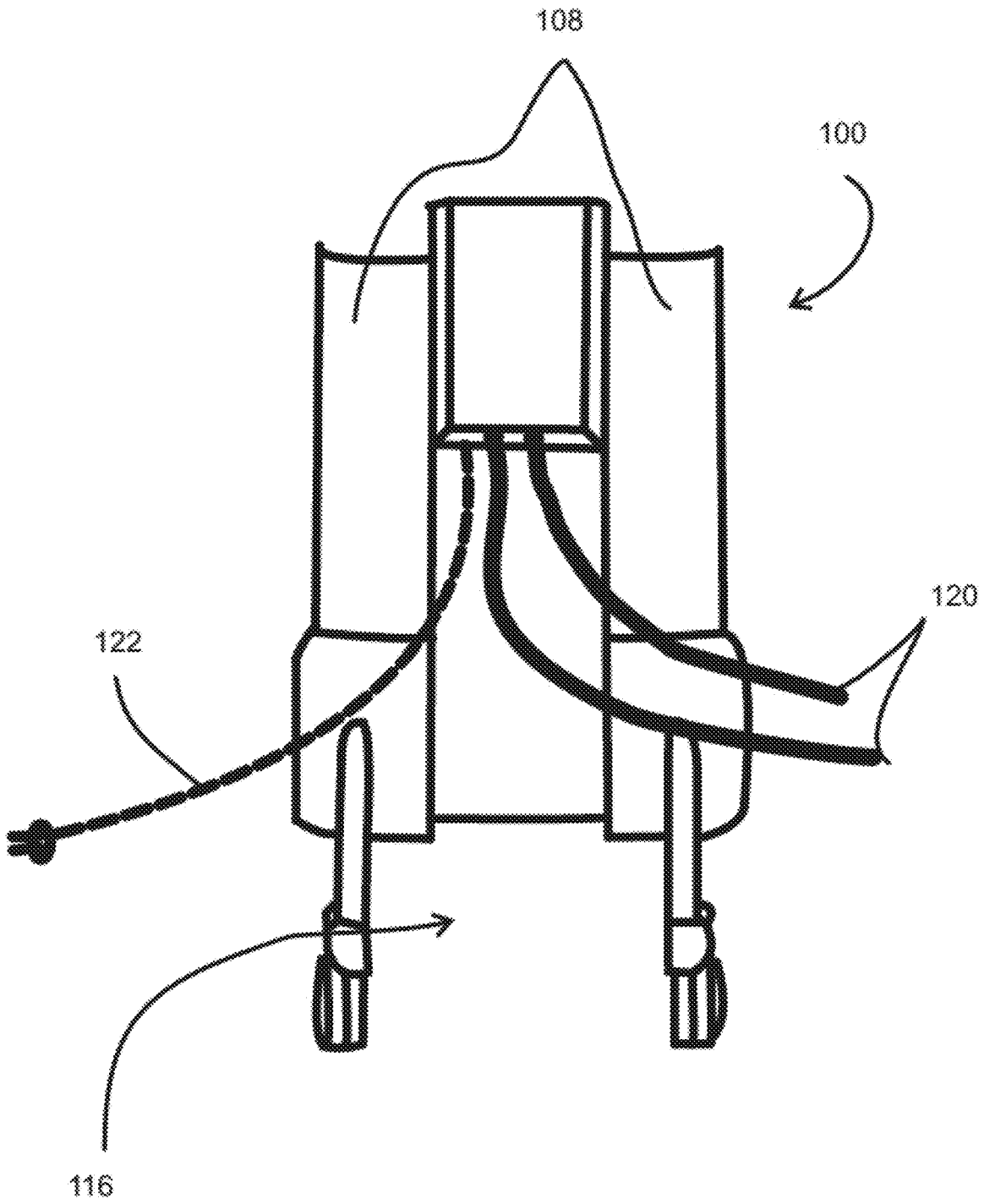
FIG. 3*c* is a back view of the semi-open bathing device of FIG. 3*a;*

Referring to FIGS. 3*a*-3*c*, which illustrates the side view, front view and back view of a "semi-open" bathing or showering device 100 according to one embodiment of the present disclosure. The semi-open bathing device 100 comprises a chair assembly having a seat 102 in its center and a backrest 104, a plurality of first dispensers 106, a supply assembly for connecting to the water supply 120 and electricity supply 122, a temperature regulator (not shown), two water barrier side walls 108 and a waste water management system 110.

In the semi-open bathing device 100, the chair assembly comprises a seat 102 with a hole 112 disposed in the center of the seat 102. The backrest 104 and two sidewalls 108 are coupled to the seat 102 respectively thereby forming a front opening for the chair assembly. The backrest 104 provides a support for the bather and the two sidewalls 108 are configured to contain the spillage of water. The plurality of first dispensers 106/106*a* is positioned onto the sidewalls 108 and/or the backrest 104 for dispensing water and/or air towards the bather. The supply assembly 107 is located at backside of the backrest 104 for connecting to a water supply 120 and an electricity supply 122. Water from the water supply 120 may flow to the first dispensers 106/106*a* for spraying and the electricity supply 122 powers the function of the bathing device 100. The plurality of first dispensers 106/106*a* is connected to the supply assembly 107 such that the first dispensers 106/106*a* may dispense water from the water supply 120. The temperature regulator (not shown) is coupled to the chair assembly for regulating the temperature of the dispensed water and/or air. The waste water management assembly 110 comprises a water collector being coupled to the central hole of the seat for collecting the waste water. The seat, the sidewalls, and the backrest are coupled in such a manner to contain and guide the waste water to the central hole and then the waste water management assembly. In this way, the waste water management assembly 110 may comprises the seat 102, the sidewalls 108, the hole 112 as shown in in FIG. 3*b*.

Still referring to FIGS. 3*a*-3*c*, the chair assembly may further comprise a foot tray 114 positioned in front of the seat 102, such that the bathing water that flows to the feet may be contained. In this manner, the foot tray 114 may be configured to be a part of the waste water management assembly 110 as shown in FIG. 3*b*, wherein the water contained in the foot tray 114 may be pumped back or siphoned into a toilet 300, drain or waste receptacle for disposal. This helps to reduce any mess on the ground and makes it safer for when the bather stands up to exit the device.

As further shown in FIGS. 3*a*-3*c*, the chair assembly may have a space formed beneath the seat 102 and an opening at the rear of the chair assembly. With this design, the chair assembly may be space-saving as it is capable of fitting over a toilet 300 or the like. Therefore, the bathing device 100 may be installed in a washroom or somewhere without occupying much room.

As shown in FIGS. 3*a*-3*c*, the seat 102, the sidewalls 108, and the backrest 104 are coupled together in a substantially water tight manner. In this case, the seat 102, the sidewalls 108 and the backrest 104 are formed together to be a semi-open space. The backrest 104 and the sidewalls 108 may be functioned as a barrier to block the showering water from splashing outside, and the seat 102 with the backrest and the sidewalls will guide the waste water to the central hole 112 therein and then the water collector of the waste water management assembly 110. In this manner, the seat 102 may have an inwardly sag towards the hole 112 so that the waste water may flow into the hole 112 rather than remaining on the seat 102. Since a front opening for the chair assembly is formed, the semi-open space does not obstruct the entry or exit of a bather and helps to contain shower water in order to minimize mess. In a further embodiment, a door (not shown) or a curtain (not shown) may be arranged to the front opening so as to further block the showering water from splashing outside. In a further embodiment, the sidewalls 108 may be transparent or translucent.

Figure 4A:
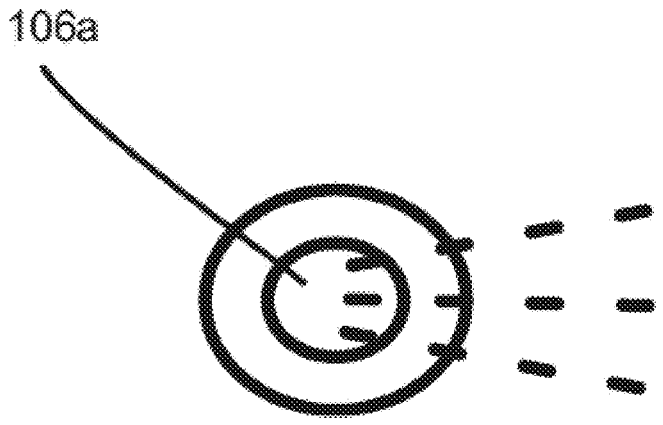
FIG. 4*a* is a schematic diagram of a first dispenser spraying water at an angle.
Figure 4B:
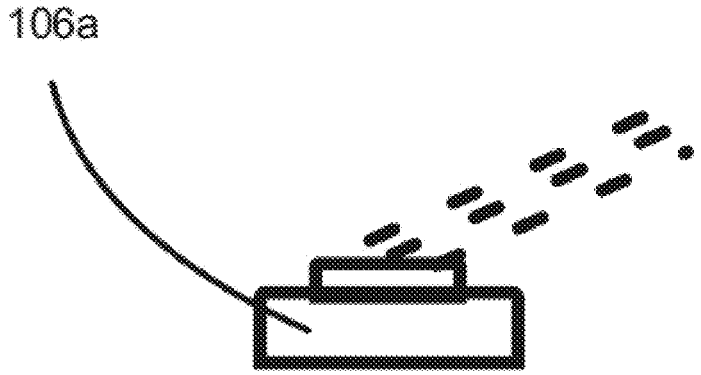
FIG. 4*b* is another schematic diagram of the first dispenser spraying water at an angle.

The plurality of first dispensers 106/106*a* are disposed inside the semi-open space, especially onto the backrest 104 and the sidewalls 108 as shown in FIG. 3*b*. Referring to FIGS. 4*a*-4*b*, the plurality of first dispensers 106/106*a* are arranged at an angle, so that the dispensers may spray the water and/or air at an angle "shearing" or crisscross motion across the back of the bather rather than perpendicular to it. The "shearing" spray of the first dispensers 106/106*a* allows the water to stay within a small bathing area even when the bather steps out of the device. In another embodiment, the plurality of first dispensers may each further comprises a nozzle which is movable at angles. In this manner, the plurality of dispensers 106/106*a* may not be arranged at special angles as the nozzles may be adjusted at angles to the spray the water. Furthermore, the various-angle spray of the water may also wash and clean the bather from all sorts of angles. As shown in FIG. 4*a*-4*b*, the dispensers 106/106*a* are preferably spraying at an almost 45 degrees angle. However, larger or smaller angles are also possible. In this embodiment, the first dispensers may be divided into separately controllable zones or regions, such that some of the first dispensers may be angled to spray into the formed space from the side or front and downwards towards the foot tray to clean the feet, and other first dispensers may even be configured to sprays upwards towards the armpits of the bather. Consequently, the bathing device may alternate between cleaning different areas of the body of the bather at different periods.

In a further embodiment, the bathing device may further comprise a plurality of second dispensers for spraying, dispensing or applying a fluid or liquid to the user or device such as soap, oil, perfume or disinfectant. Optionally, the second dispensers may be arranged onto the sidewall and the backrest just like the plurality of first dispensers. Consequently, the second dispensers may spray the soap, oil, perfume or disinfectant towards to the bather or the device directly.

The supply assembly 107 is located at backside of the backrest 104 for connecting to a water supply 120 and an electricity supply 122. The water supply 120 may be connected to the plurality of first dispensers with piping or conduits. In this embodiment, the second dispensers may be connected to the piping (not shown) or conduits (not shown) between the water supply 120 and the first dispensers 106/106*a* so that the second dispensers may mix the fluid or liquid with water from the water supply 120 in the piping or conduit.

The electronic devices of the bathing device are connected to the electricity supply 122, such that they can obtain electricity power from the electricity supply 122.

In one embodiment, the temperature regulator may comprise a switch for the user to manually adjust the bathing temperature. In another embodiment, the temperature regulator may comprise a temperature sensor, with which the temperature regulator may automatically adjust the temperature of the dispensed water and/or air by analyzing the feedback from the temperature sensor. In these embodiments, the temperature regulator may comprise a water mixer, water heater or water buffer for mixing/heating/buffering the water to be dispensed thereby regulating the temperature of the dispensed water. In a further embodiment, the temperature sensor is connected to the control unit so that the control unit may analyze the feedback from the temperature sensor and command the water mixer, water heater or water buffer to regulate the temperature of the dispensed water.

In one embodiment, a detecting sensor is further provided to the bathing device. The detecting sensor may be triggered when the bather leaves the seat. In this manner, said plurality of first dispensers may be turn off or adjusted in response to the bather's move. In a further embodiment, the detecting sensor is connected to the control unit so as to transmit sensed signal to the control unit, and the control unit commands to turn off or adjust the first dispensers.

In one embodiment, the waste water management assembly may further comprises a pump (not shown) configured to pump or siphon the waste water from the foot tray or the water collector into a toilet 300 or the like.

In one embodiment, a warmer (not shown) is provided to the bathing device and connected to the control unit. The control unit is configured for controlling or operating the warmer.

Optionally the sequence and control over the cleaning zones are automatically or digitally controlled through a program or by the user's input. The user input method could include a keyboard, remote, external device (such as phone or tablet), facial recognition, scanning, barcode, sensor or voice recognition. This helps facilitate automated and/or electronically controlled cleansing of various areas of the body. Preferably there is a feedback system such as a speaker, alert system or electronic screen. In one embodiment, the user input may be connected to a control unit, and the control unit may process the user's input and converts it as a command to control the first dispensers 106/106*a* and the second dispensers. In this manner, the spray angle of the first dispensers 106/106*a* may be controlled by the user's input. The feedback system may provide the real-time feedback of the user's input for the user so that the user can understand whether his/her input is effective or not.

Figure 5:
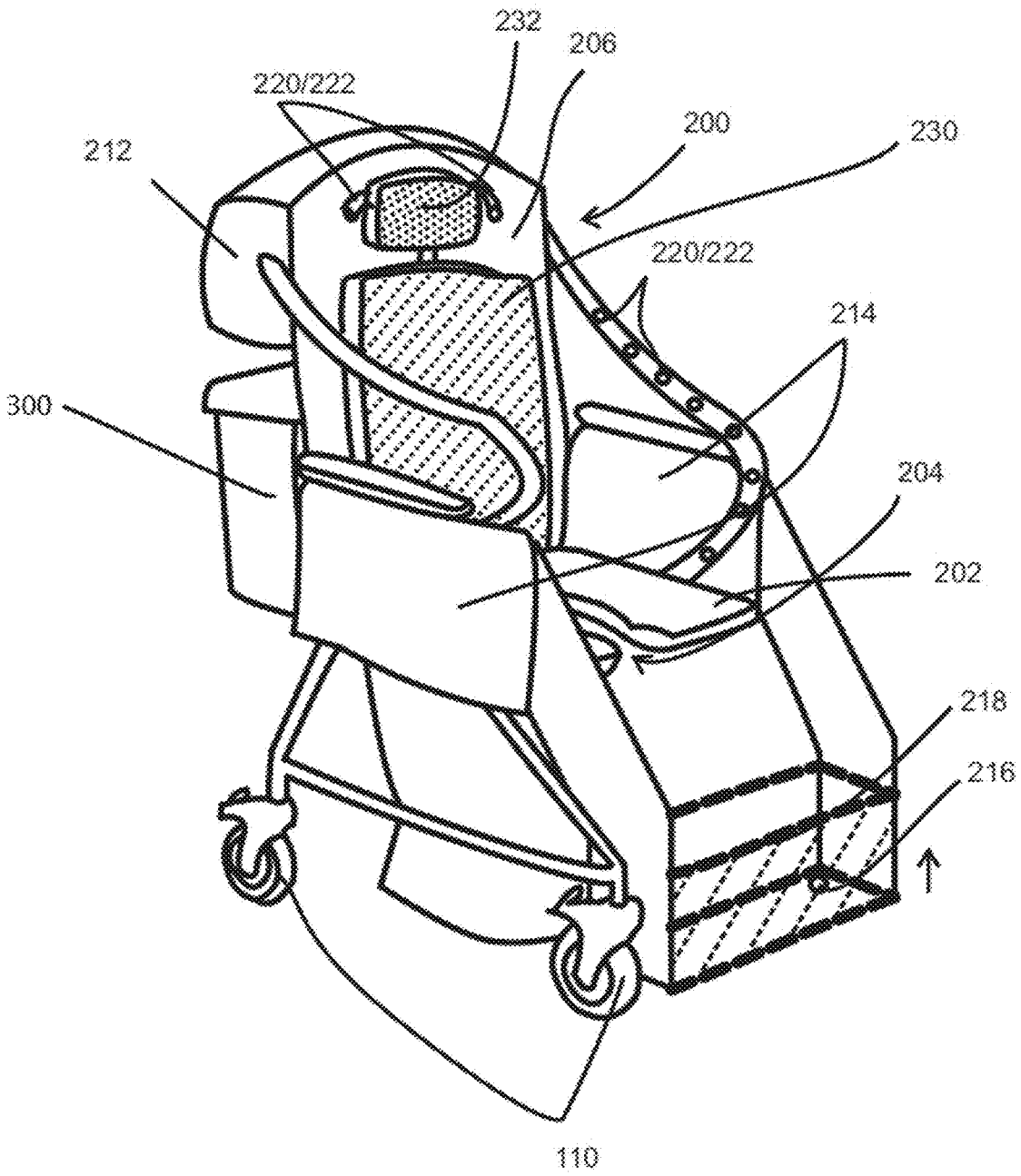
FIG. 5 is a schematic diagram of a bathing device according to another embodiment of the present disclosure.

In another embodiment as shown in FIG. 5 which illustrates another bathing device 200. The bathing device 200 comprises a chair assembly having a seat 202 in its center and a backrest 206, a plurality of first dispensers 220/222. A control unit 212 is mounted on the back of the backrest 206 in an elevated position. The bathing device 200 also has wheels 110 that are spaced to allow the device to move. Since a space is formed beneath the seat 202 with an opening at the rear of the bathing device, the bathing device may "back into" a toilet 300 by way of the wheels 110 so that the seat 202 may fit above the toilet bowl.

Preferably, the first dispensers 220/222 may comprise a tube, pipe or an elongated member with perforations or nozzles. The first dispensers 220/222 may optionally share the same tube or pipe or be separated. More preferably the first dispensers 220/222 are connected to the control unit 212. Preferably the control unit 212 contains means for heating water or air and sensing the temperature of the water or air. The means for heating water may be a water heater which could heat the water via electricity. The means for sensing the temperature of the water or air may be a temperature sensor. In use, the temperature sensor may sense the change of temperature and the heater may then receive the feedback from the temperature sensor and turn up/down itself to adjust the water/air temperature, or even turn off itself.

Still referring to FIG. 5, the foot tray 216 also comprises a collapsible bucket structure 218, wherein the bucket 218 is raised in FIG. 5, but it may be collapsed in another working condition. The center portion 217 of the bucket structure 218 may be used to contain the used water.

The backrest 206 may include a scrubbing assembly 230. Optionally the scrubbing assembly 230 includes a front screen 302 that helps facilitate drying and cleaning of the back. A headrest 232 is mounted on top of the backrest 206 and preferably contains the first dispensers 220/222. Preferably the structure of the headrest allows for easy washing and drying of the hair and the headrest can be moved up or down on a rail (similar to car headrest). Alternatively the headrest can be mounted on the backrest 206.

FIGS. 6*a*-6*d* illustrate a further embodiment of the present disclosure. The bathing device depicted in FIGS. 6*a*-6*d* is similar to the one in FIGS. 3*a*-3*c* and 5 but where the water is better contained within the device 200. Once again, the water is shaped to guide water through a central hole 204 and into a toilet 300. Mounted on the water barrier sidewalls 214 is a set of curtains 224 to help keep water from splashing out. Optionally, the device also contains a control unit to control the flushing of the toilet 300.

Figure 6A:
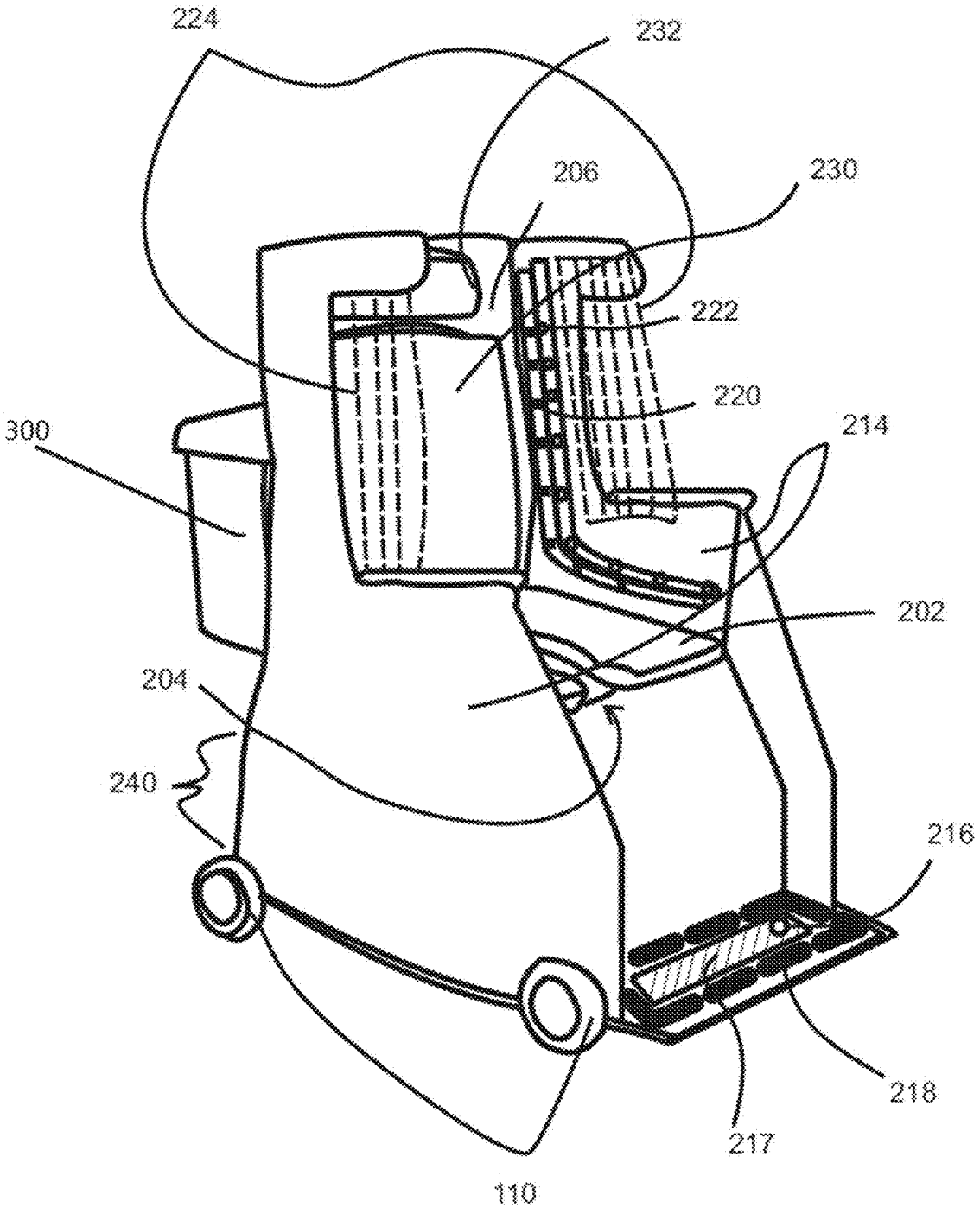
FIGS. 6*a*-6*c* is schematic diagram of a bathing device according to another embodiment of the present disclosure, wherein the foot tray are at different positions.
Figure 6B:
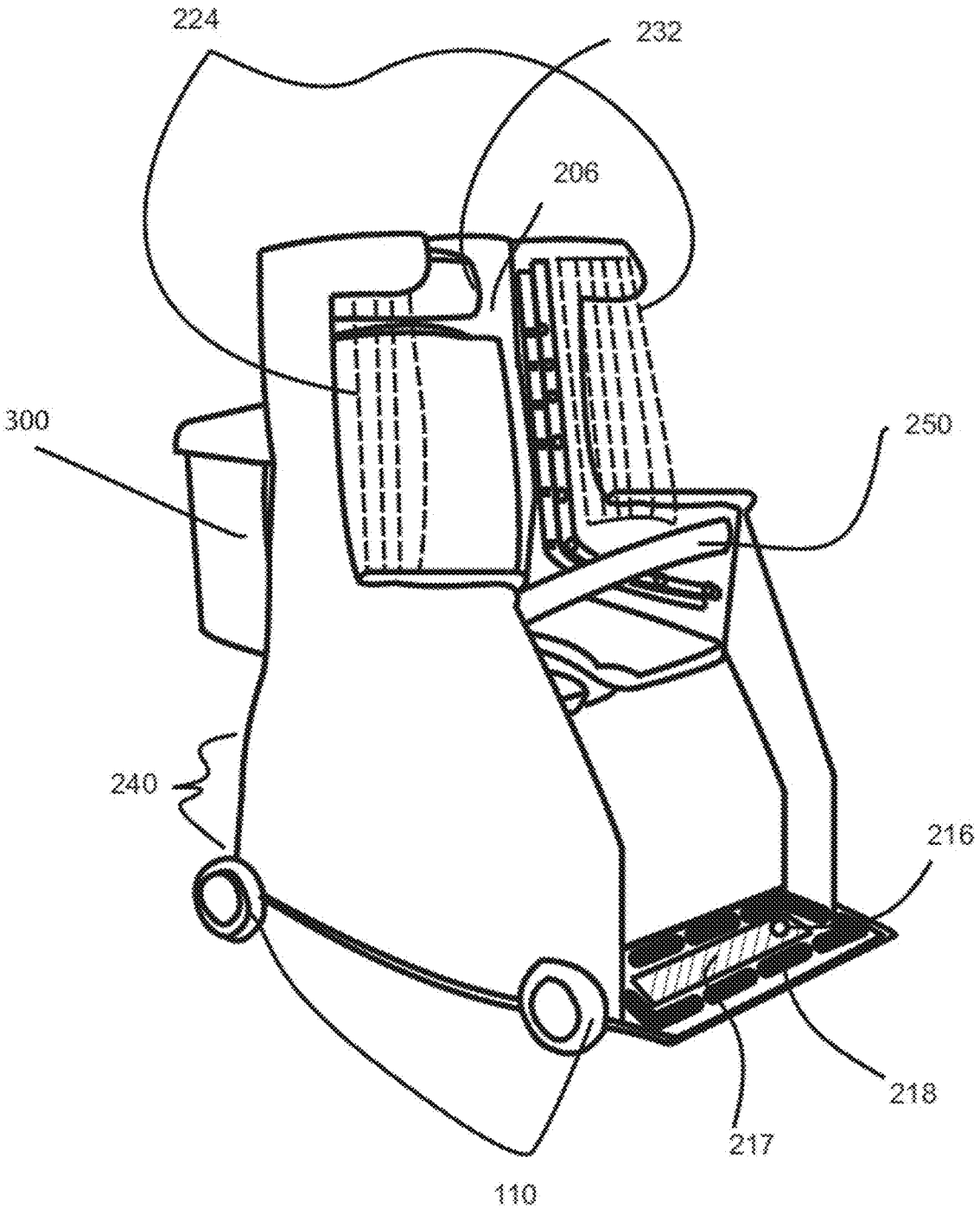
Figure 6C:
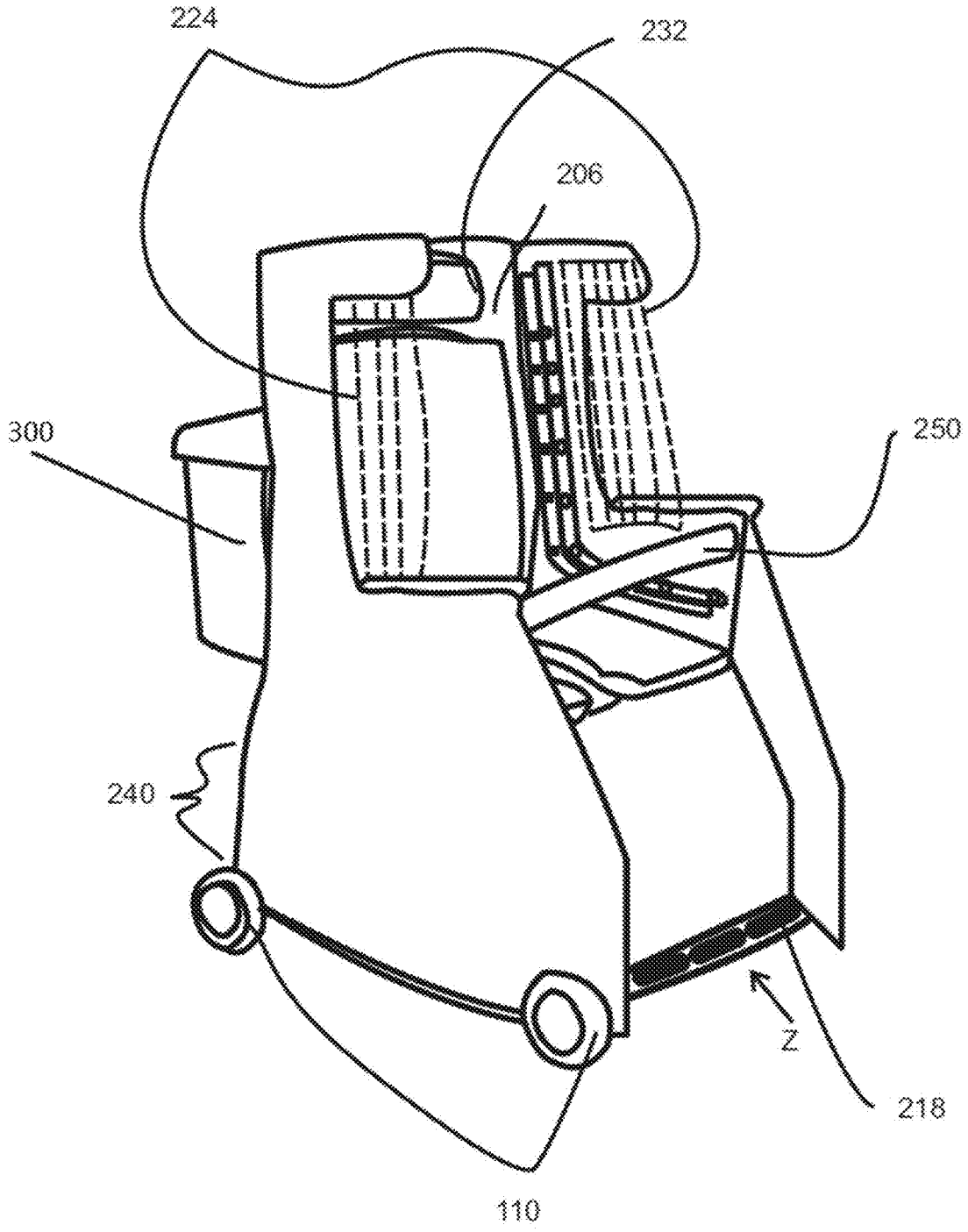
Figure 6D:
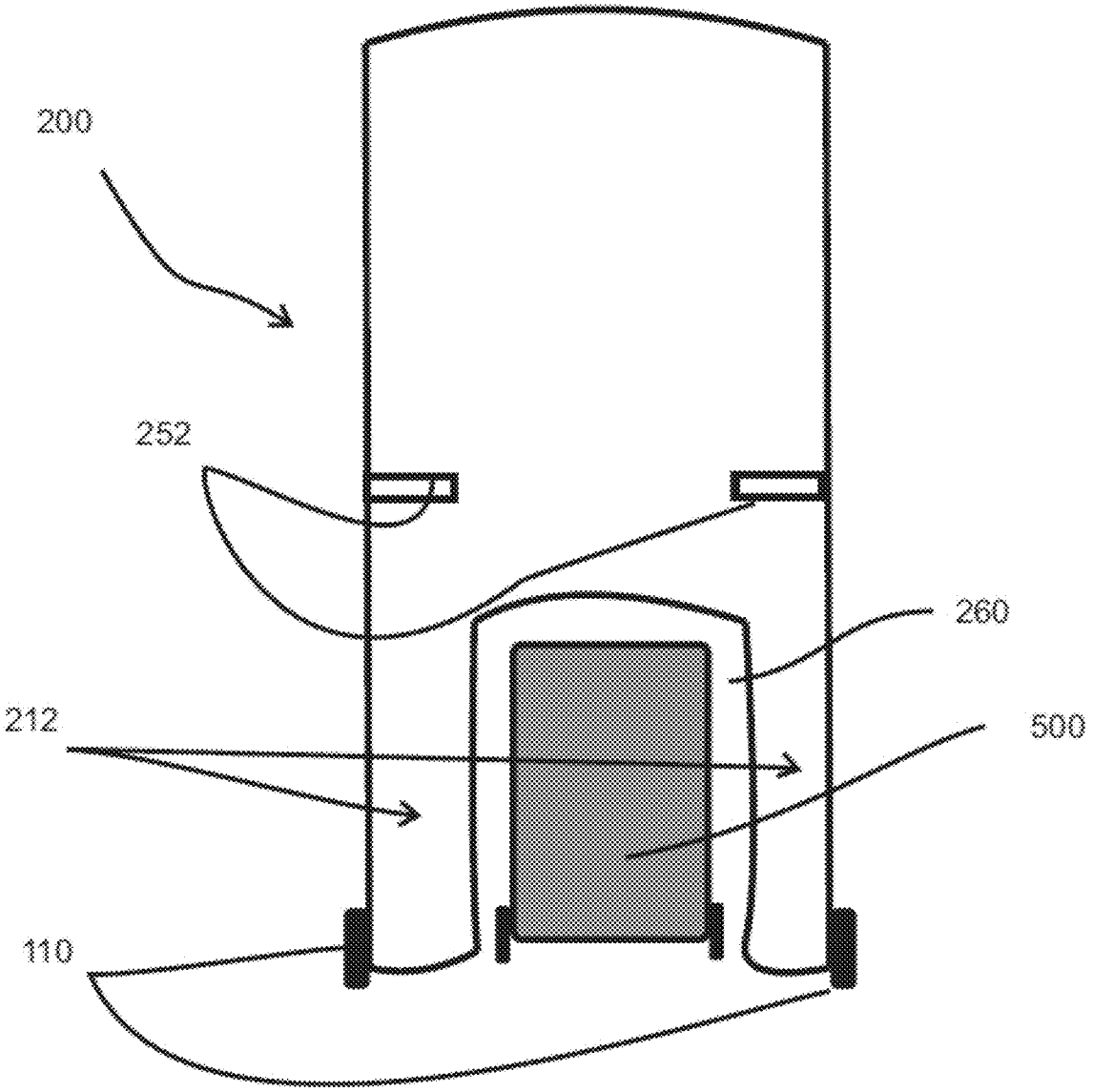
FIG. 6*d* is a rear view of the bathing device of FIGS. 6*a*-6*c;*

The control unit 212 as shown in FIG. 6*d* is relocated such that it may occupy a space on either side of lower area 240 of the device 200.

In FIG. 6*c*, the bathing device 200 also has a central safety bar 250. This safety bar is further described later in FIGS. 10*a*-10*c*.

Preferably, the collapsible bucket 218 which is shown to be out in FIG. 6*b* can slid under the seat. Alternatively, the collapsible bucket 218 may be removed, hidden away or changed.

Optionally, the bathing device 200 may be reclined, titled or have its foot tray raised.

FIG. 6*d* depicts the rear view of the bathing device 200 with handle bars 252 and wheels 110. A space or cavity with an opening at the rear 260 can accommodate the toilet 300 to be fitted under the seat of the device, however, in the case of FIG. 6*c*, the space has been occupied by a portable toilet, wastage tank, fresh water supply or combination thereof 500. The portable toilet or waste tank 500 can be used to collect excrement or water should the bathing device 200 be used outside of a bathroom. The fresh water supply can b used to provide bathing water.

Figure 7A:
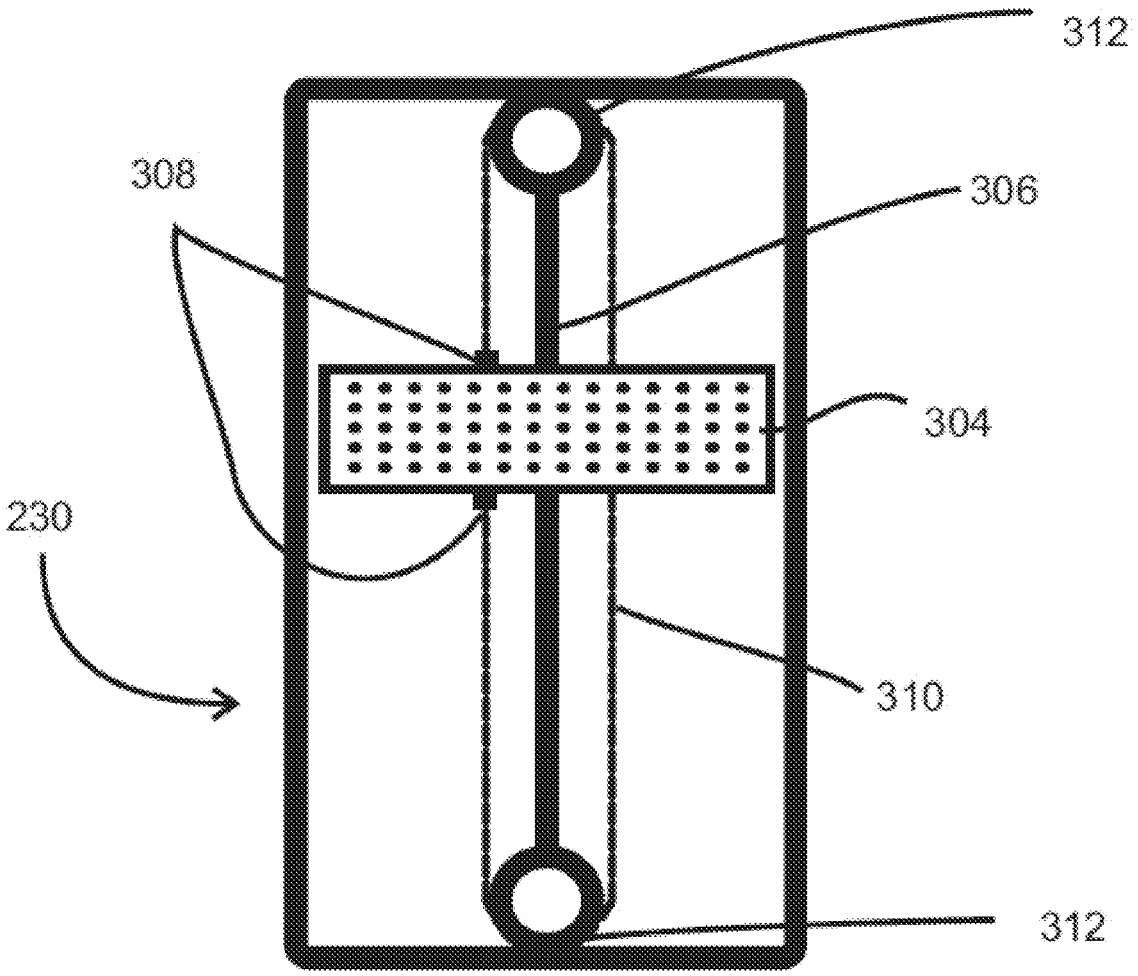
FIGS. 7*a*-7*c* is a front view of a scrubbing assembly with a front screen and a moving brush or cleaning member.
Figure 7B:
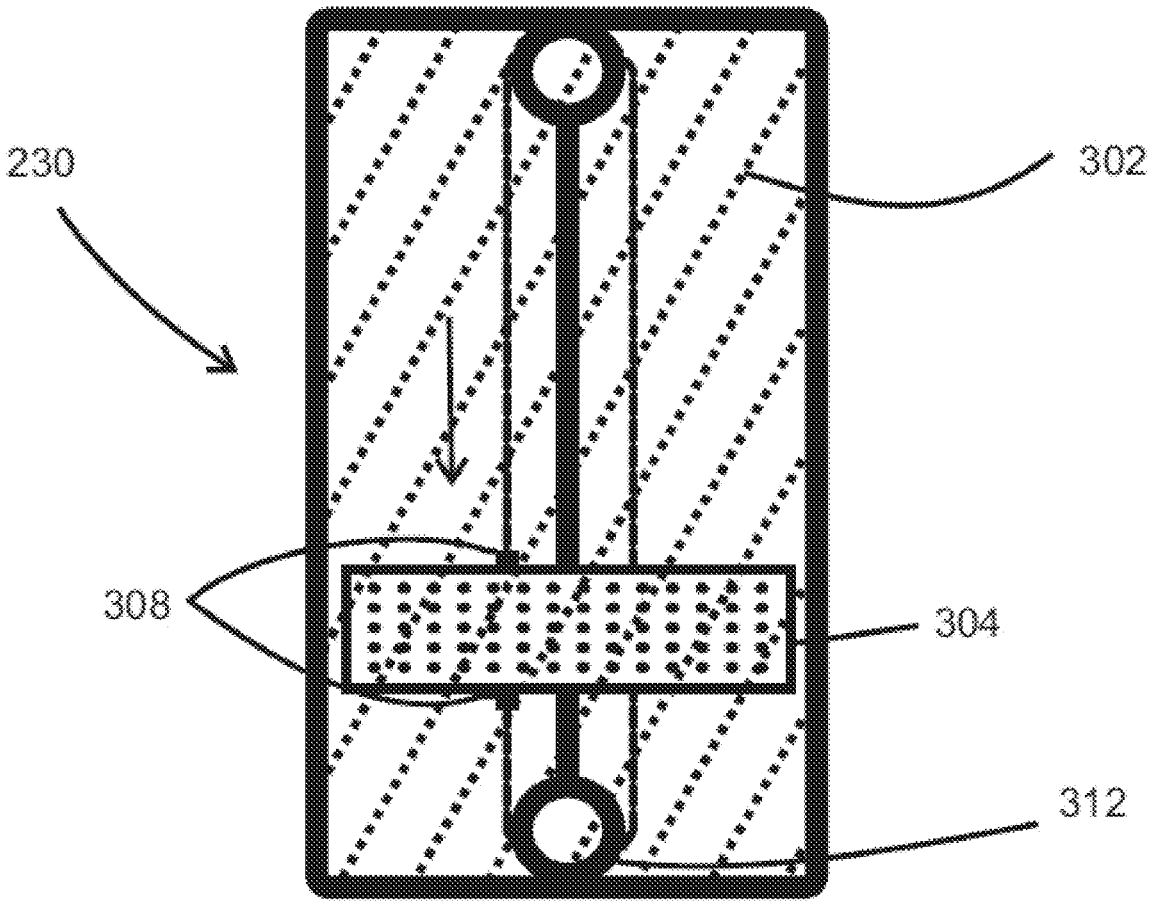
Figure 7C:
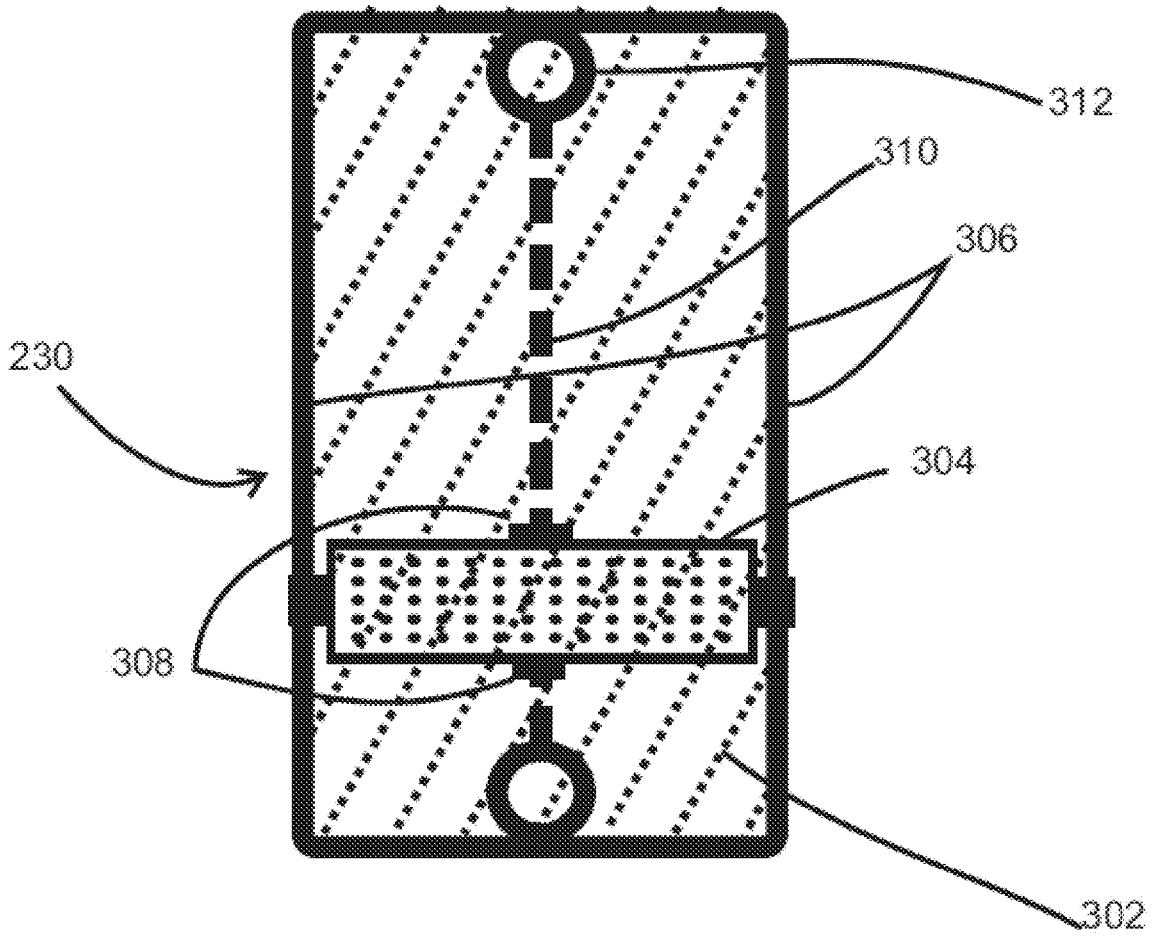

In another aspect of the present disclosure, FIGS. 7*a* and 7*c* depicts the front of a scrubbing assembly 230 with a front screen 302 and a moving brush or cleaning member 304. Preferably the cleaning member follows a track 306 and is fastened by fasteners 308 to a belt 310. More preferably, the belt 310 moves along a pulley system 312. Alternatively, the cleaning member or brush 304 can be moved by a linear actuator. FIG. 7*c* depicts another embodiment of the scrubbing assembly 230 where the track 306 is the outer frame of the scrubbing assembly 230.

Figure 8A:
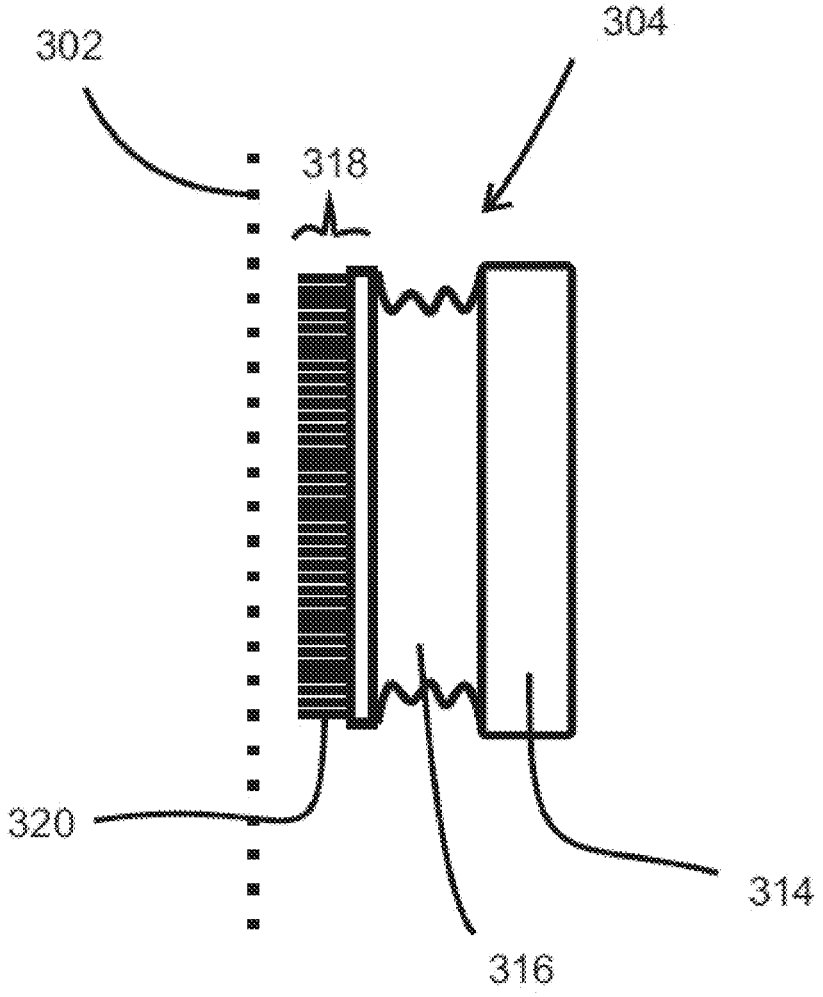
FIGS. 8*a*-8*c* illustrate a side view of examples of a cleaning member.
Figure 8B:
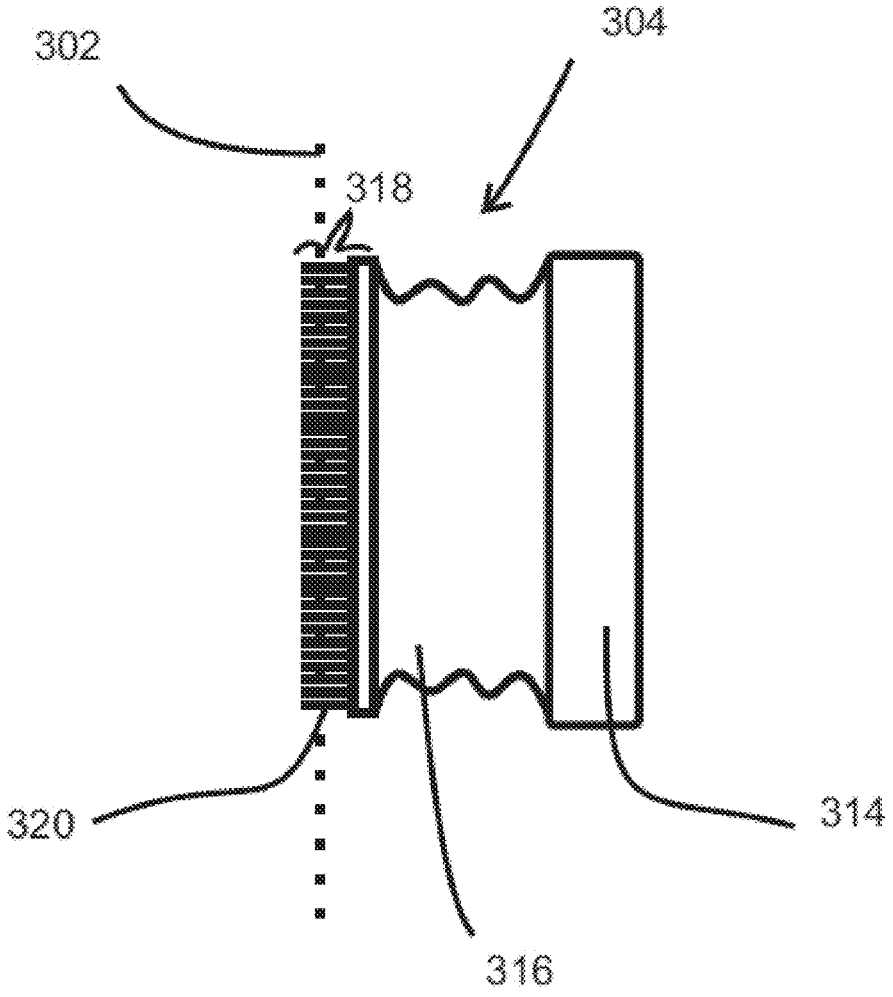

Referring to FIGS. 8*a*-8*b* which illustrates a side view of one example of a cleaning member 304. Preferably, the cleaning member 304 has a back part 314 that slides along the track 306 as it is moved by the belt 310. In front of the back part is an expandable mid part 316 which is then connected to a brush or scrubbing surface 318. Preferably the brush 318 has soft bristles 320.

Figure 8C:
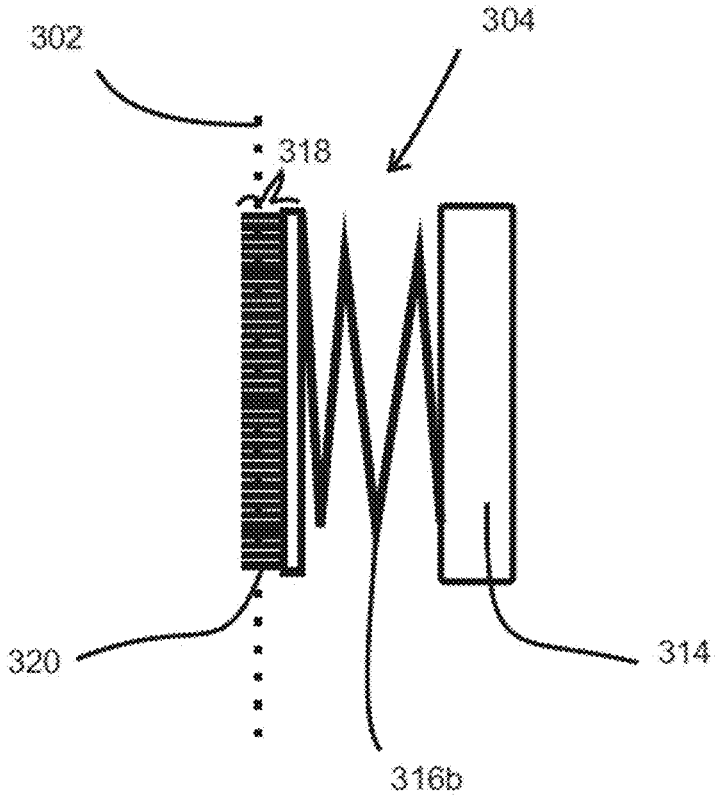

When the mid part 316 is expanded (as in FIG. 8*b*), the bristles 320 are able to extend beyond the surface of the front screen 302 to clean the back of the user. When the mid part 316 is contracted (as in FIG. 8*b*), the bristles 320 are behind the front screen 302 and no scrubbing occurs. Preferably, the expandable mid part 316 is in the form of an air bag. In FIG. 8*c*, the mid part 316 is in the form of a spring.

Figure 9A:
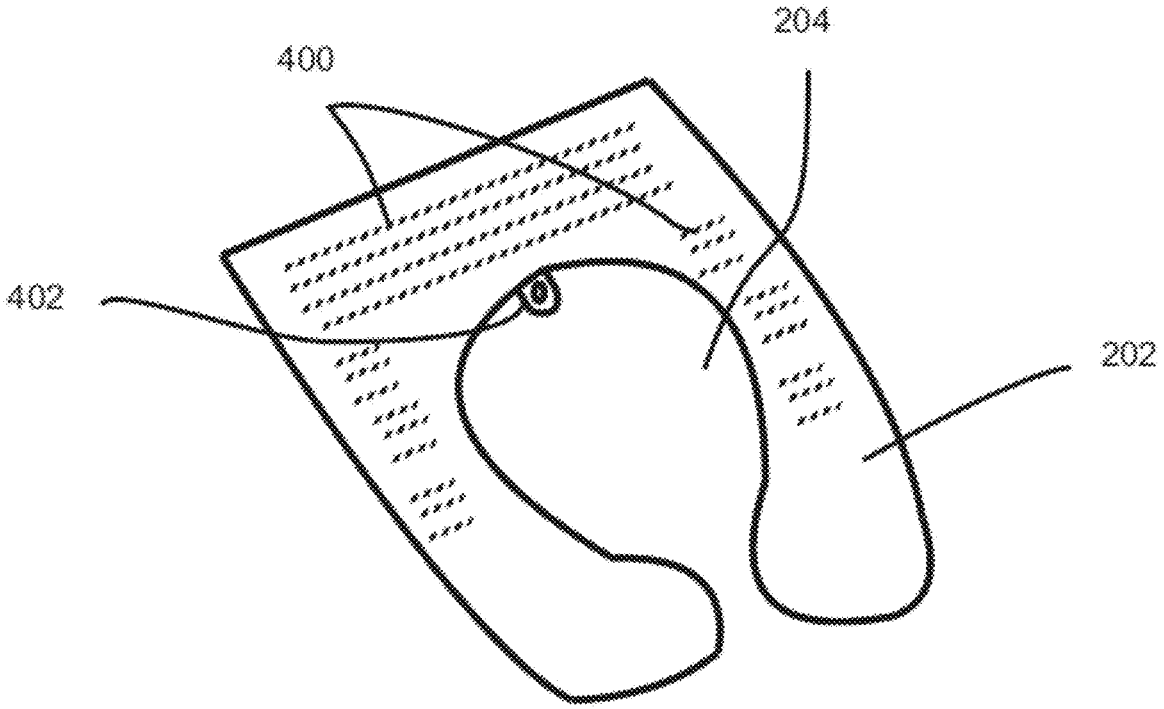
FIGS. 9*a*-9*c* illustrate a buttocks cleaning system with a bidet.
Figure 9B:
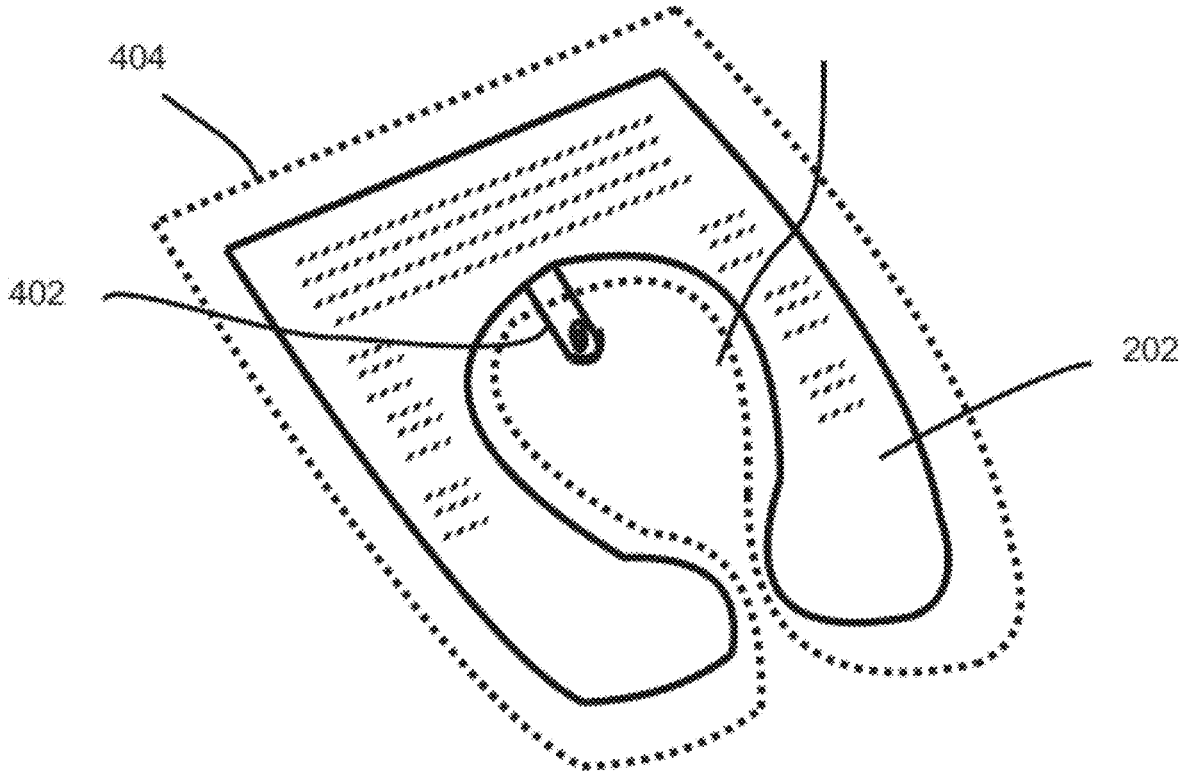
Figure 9C:
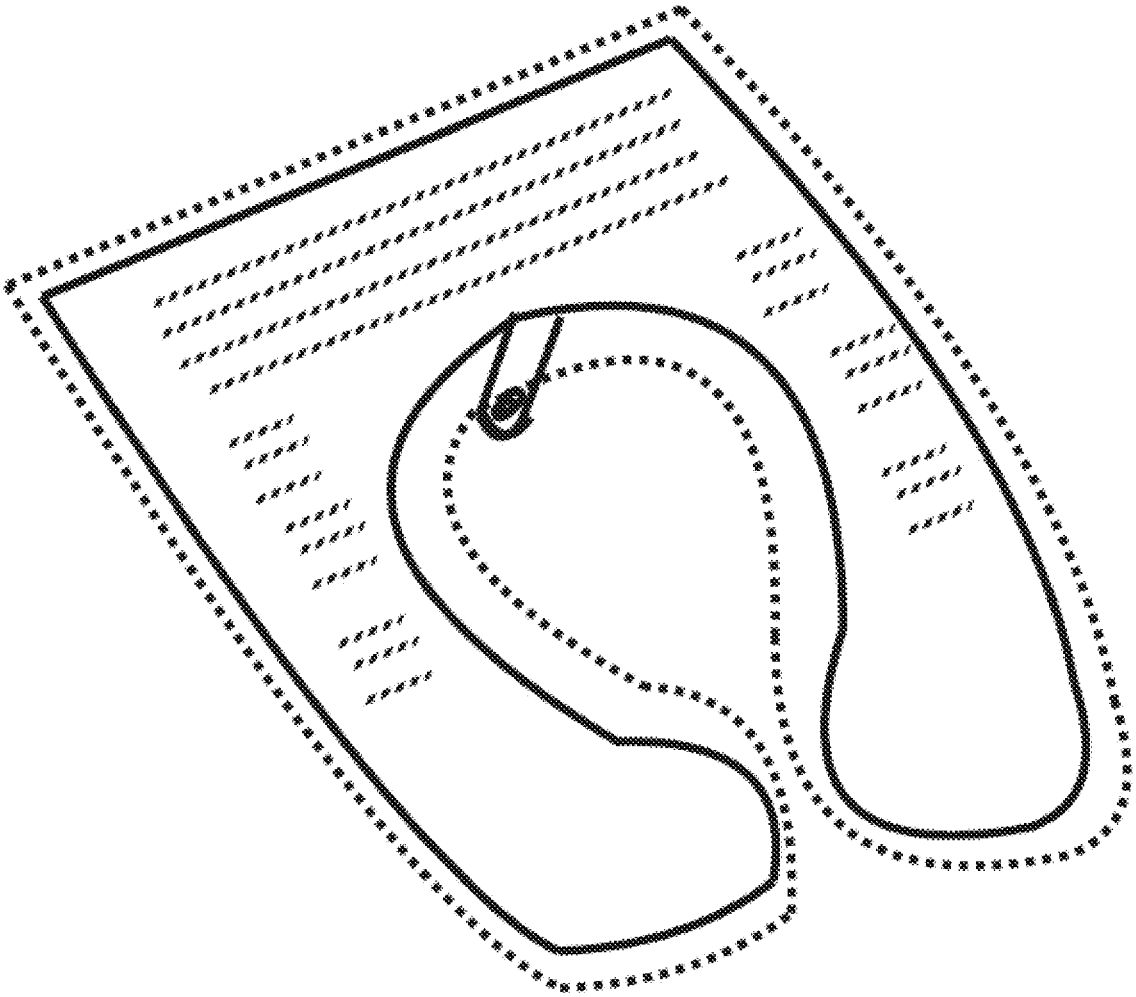

In yet another aspect of the present disclosure, FIGS. 9*a*-9*c* describes a buttocks cleaning system with a bidet for the anus. The seat preferably comes with an uneven surface 400. This could be in the form of a brush, pad, bristles, etc. Upon vibration or other movement, the uneven surface 400 can be used to clean the buttocks.

Preferably, a bidet 402 extends below or from a back portion of the seat 202 and into the central hole 204. Preferably the bidet 402 may extend out as in FIG. 9*b*, retract as in FIG. 9*a*, move side-to-side as in FIG. 9*c* or rotate (not shown). Pressurized water from the bidet 402 can be used to clean the anus. Optionally, the seat 202 can also be covered by a horse shoe shaped hygiene cover 404 that can be fitted on top of the seat 202 or fitted on like a sleeve.

Optionally, the bidet 402 can be fitted or accompanied by a brush, bristles or a balloon (not shown) to lightly scrub the anus.

Figure 10A:
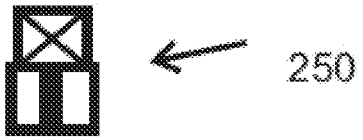
FIGS. 10*a*-10*c* illustrate a central safety bar for the embodiments of the present disclosure.
Figure 10B:
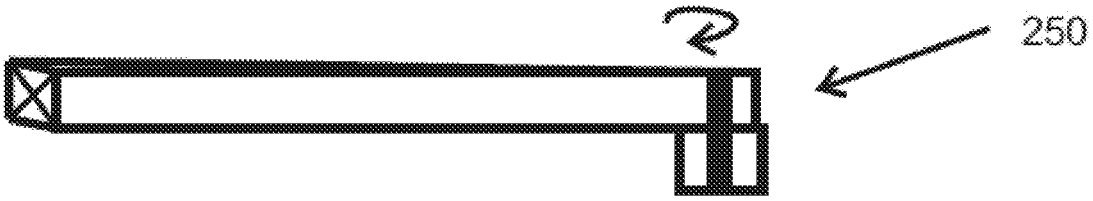
Figure 10C:
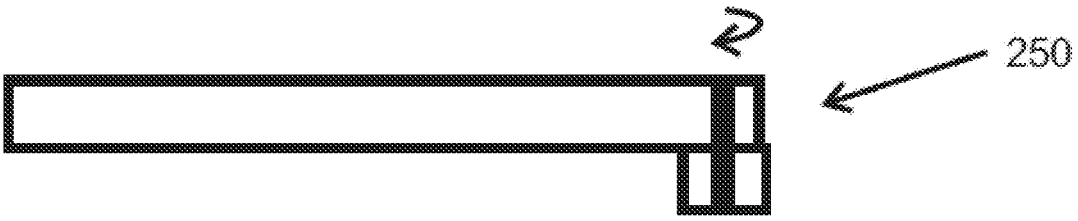

FIGS. 10*a*-10*c* depicts a central safety bar for the aforementioned embodiments. Preferably, this safety bar 250 is a rotatable bar that can latch on and lock in place. In FIG. 10*a*, the central safety bar is rotated outward giving us a view of the extended end of the bar. In FIGS. 10*b* and 10*c*, the central safety bar is rotated inwardly. More preferably, the safety bar 250 contains the first dispensers 220 for dispensing water and optionally a brush for cleaning the front or genital area. The input device may also be mounted on the safety bar.

Figure 11A:
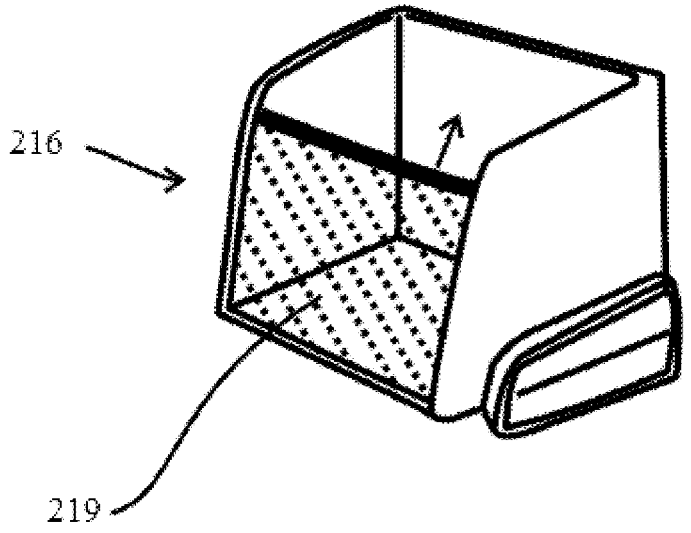
FIG. 11*a*-11*b* illustrate a front door for the foot tray according to one embodiment of the present disclosure.
Figure 11B:
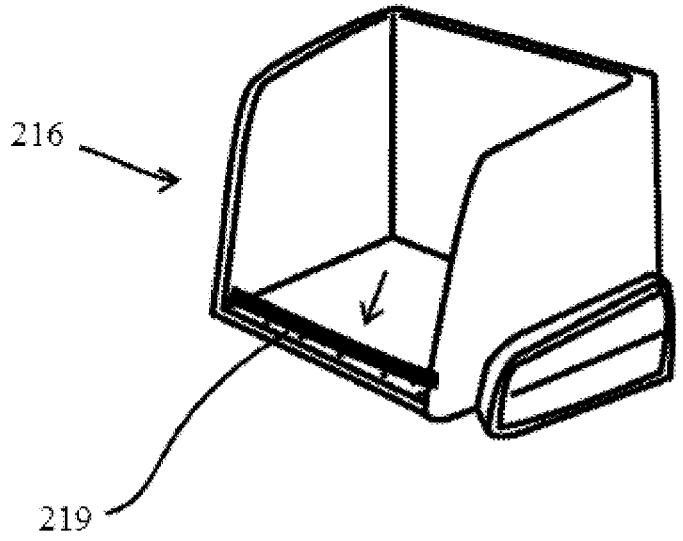

Referring to FIGS. 11*a*-11*b*, the foot tray 216 includes a front door 219 that closes upon the commencement of bathing. In this embodiment, the front door 216 is a shutter which is raised in FIG. 2*a* and is lowered in FIG. 2*b* for easy entry. However, it is to be understood that the front door 219 may be flap door that can be electronically raised when the user initiates bathing.

While the preferred and alternate embodiments have been shown and described, there is no intention to limit the disclosure to such disclosure, but rather all modifications and alternate constructions are covered that fall within the sprit and scope of the disclosure as defined in the appended claims.

What is claimed is:

1. A semi-open bathing device, comprising:

a chair assembly having a seat with a hole, wherein a backrest and two sidewalls are coupled to the seat respectively thereby forming a front opening for the chair assembly when in use, and the semi-open bathing device unobstructs entry or exit of a bather and helps to contain shower water when in use;

a plurality of first dispensers being positioned onto the sidewalls or the backrest, for dispensing water or air;

a supply assembly, for connecting to a water supply and an electricity supply;

a temperature regulator being coupled to the chair assembly for regulating the temperature of the dispensed water or air;

and a waste water management assembly comprising a water collector arranged below or coupled to the hole of the seat;

wherein the seat, the sidewalls, and the backrest are coupled in such a manner to contain and guide the waste water to the hole and then the waste water management assembly; and the plurality of the first dispensers are divided into separately controllable zones and the plurality of first dispensers each comprises a movable nozzle configured to spray the water in an angle so as to keep water substantially within the device.

2. The semi-open bathing device of claim 1, further comprising a foot tray positioned in front of the seat for placing feet of a bather and containing the water that flows to the feet of the bather and configured to contain.

3. The semi-open bathing device of claim 2, wherein the waste water management assembly further comprises a pump configured to pump or siphon the waste water from the foot tray or the water collector.

4. The semi-open bathing device of claim 1, wherein said plurality of first dispensers are arranged to spray towards the body of a bather from multiple angles.

5. The semi-open bathing device of claim 1, wherein said plurality of first dispensers comprise water nozzles that are positioned or crafted to spray towards the bather, against a side wall or towards a foot tray, or in a shearing or crisscross motion across the back.

6. The semi-open bathing device of claim 1, further comprising a detecting sensor and a control unit provided in the bathing device; wherein the detecting sensor is configured for detecting whether the bather is leaving the seat and the control unit commands to turn off or adjust said plurality of first dispensers based on the detected signal from the detecting sensor when the bather leaves the seat.

7. The semi-open bathing device of claim 6, wherein a warmer is provided to the bathing device, and the control unit is further configured for controlling or operating the warmer.

8. The semi-open bathing device of claim 6, wherein the control unit further configured for automatically alternating water, soap or disinfectant dispensing through a range of zones.

9. The semi-open bathing device of claim 1, wherein the chair assembly has a space formed beneath the seat and an opening at the rear of the chair assembly for accommodating a toilet, or water supply under the seat, making the bathing device installable over the toilet to allow toilet use while bathing.

10. The semi-open bathing device of claim 1, wherein said sidewalls, said backrest and said seat are joined together in a substantially water tight manner.

11. The semi-open bathing device of claim 1, further comprising a bidet being positioned on the seat for cleaning the buttocks or genital areas of the bather.

12. The semi-open bathing device of claim 1, wherein said temperature regulator comprises a water mixer for mixing, water heater for heating or water buffer for buffering the water to be dispensed.

13. The semi-open bathing device of claim 1, further comprising an input means, allowing the bathing device to clean the various areas of the body of the bather in a sequence automatically or digitally controlled through a program or by a user input.

14. The semi-open bathing device of claim 13, wherein the input means is selected from the group consisting of keyboard, remote, external device, facial recognition, scanning, barcode, sensor, voice recognition, or combination thereof.

15. The semi-open bathing device of claim 1, comprising a user feedback system such that the bather is capable of interacting with the bathing device and commanding the bathing device.

16. The semi-open bathing device of claim 1, further comprising a plurality of second dispensers for dispensing a fluid or liquid, including soap, oil, perfume or disinfectant, to the user or device.

17. The semi-open bathing device of claim 16, wherein the second dispenser is connected to a piping between the first dispenser and the water supply and is configured to mix the fluid or liquid with water before the water is dispensed from the first dispenser.

18. The semi-open bathing device of claim 1, further comprising an odour management assembly, wherein the odour management assembly comprises an exhaust fan, an air filter or a perfume dispenser.

19. The semi-open bathing device of claim 1, further comprising a scrubbing assembly for scrubbing the back or buttocks of the bather.

20. The semi-open bathing device of claim 19, wherein the scrubbing assembly comprises a mesh screen or movable brush.

* * * * *